US007820564B2

(12) United States Patent
Liou et al.

(10) Patent No.: US 7,820,564 B2
(45) Date of Patent: Oct. 26, 2010

(54) FABRIC WITH A MOISTUREPROOF, DUSTPROOF AND ANTIBACTERIAL FUNCTION

(75) Inventors: Guan-De Liou, Taipei (TW); Chia-Pine Huang, Keelung (TW); Li-Li Lai, Taipei (TW); Stephen Tsai, Taipei County (TW)

(73) Assignee: Hannspree, Inc., Taipei (TW)

( * ) Notice: Subject to any disclaimer, the term of this patent is extended or adjusted under 35 U.S.C. 154(b) by 0 days.

(21) Appl. No.: 12/548,700

(22) Filed: Aug. 27, 2009

(65) Prior Publication Data

US 2009/0318046 A1 Dec. 24, 2009

Related U.S. Application Data

(62) Division of application No. 11/798,970, filed on May 18, 2007.

(30) Foreign Application Priority Data

Feb. 16, 2007 (TW) ..... 96105926 A

(51) Int. Cl.
*C23C 16/00* (2006.01)
*B05D 1/04* (2006.01)

(52) U.S. Cl. ..... 442/123; 427/248.1; 427/255.6; 427/331

(58) Field of Classification Search ..... 442/79, 442/85, 86, 123; 427/248.1, 255.6, 331
See application file for complete search history.

(56) References Cited

U.S. PATENT DOCUMENTS 4,921,723 A * 5/1990 Nichols et al. ..... 427/488
2005/0266981 A1* 12/2005 Nakajima et al. ..... 502/150

* cited by examiner

*Primary Examiner*—D. Lawrence Tarazano
*Assistant Examiner*—Matthew D Matzek
(74) *Attorney, Agent, or Firm*—Bacon & Thomas, PLLC

(57) ABSTRACT

The present invention relates to a fabric having a three-layered structure: a fiber substrate, a parylene layer, and an antibacterial layer. The fiber substrate is the fiber part of the fabric; the parylene layer is capable of providing a moisture-proof and dustproof effect as well as preventing the fiber substrate from being catalyzed by photocatalyst and decomposed thereby; the antibacterial layer, which comprises nano-photocatalyst and/or nano-silver particles, is used to kill pathogenic germs.

6 Claims, 3 Drawing Sheets

FABRIC WITH A MOISTUREPROOF, DUSTPROOF AND ANTIBACTERIAL FUNCTION

The present application is a Divisional application of U.S. patent application Ser. No. 11/798,970, filed May 18, 2007.

BACKGROUND OF THE INVENTION

1. Field of the Invention

The present invention relates to a fabric. More particularly, the invention relates to a fabric comprising a fiber substrate, a parylene layer, and an antibacterial layer.

2. Description of the Related Art

In the past, displays or monitors had little extra value besides providing an audiovisual effect. Due to their monotonous cubic shapes and limited color combinations, the styles of these displays seldom provide customers with an aesthetic effect or an eye-catching design. However, as a result of the burgeoning aesthetics and the popularized personalism in recent years, more and more people prefer products with better design and uniqueness; therefore, several display manufacturers begin to pay attention to the appearances of displays and, on the market, more and more displays are featured by an avant-garde color combination as well as an extraordinary shape. Among all means to increase the aesthetic effect or designs of the displays, covering a display with a fabric is the one that may increase viewers' enjoyment during the provision of an audiovisual effect.

However, because of the their inherent property, fabrics are more prone to absorb moisture from the air than plastic casings; in addition, after being handled or placed at a spot for a long period of time, the fabric may easily be covered by dust and bacteria, becoming a hotbed for pathogenic germs.

In order to provide an antibacterial and dustproof effect, several inventions, which treat a fabric or the like with nano-sliver, nano-photocatalysts or the composition thereof as an additive or a coating agent, have been disclosed. Taiwan Patent No. M249056 discloses a computer comprising a photocatalyst layer; furthermore, TW200536987 relates to a method for producing a fabric with nano-silver and a nano-silver containing fabric. Similarly, M249967 discloses a nano-silver containing fabric as well, and U.S. Pat. No. 6,979,491 is directed to yarn containing nano-silver particles. After reviewing all the patents aforementioned, one can easily find that the antibacterial effect of an article comes from the addition the nano-silver particles and/or nano-photocatalyst. However, since fiber substrates belong to organic compounds, they may also be decomposed consequently as a result of the catalysis reaction of the photocatalyst, given that no proper protection or isolation is provided. Thus, the above-mentioned inventions fail to satisfy all customers when they are embodied; in addition, none of these inventions are capable of providing a moistureproof and dustproof effect simply by the addition of the antibacterial substances.

Accordingly, there is a need for providing solutions to the highly demanded fabric functions.

SUMMARY OF THE INVENTION

It is therefore an objective of the present invention to provide a fabric having a three-layered structure for satisfying the demand for a moistureproof, dustproof, and antibacterial function. The three-layered structure is consisted of a fiber substrate, a parylene layer, and an antibacterial layer, wherein the fiber substrate is the fiber part of the fabric, the parylene layer is capable of providing a moistureproof and dustproof effect as well as preventing the fiber substrate from being catalyzed by photocatalyst and decomposed thereby, and the antibacterial layer, which comprises nano-photocatalyst and/or nano-silver particles, is used to kill pathogenic germs It is another object of the present invention to provide a method of treating a fabric; the method forms a parylene layer on the fabric by means of chemical vapor deposition in the beginning and forms an antibacterial layer thereon afterwards.

It is still another object of the present invention to provide a display having a fabric cover, mainly comprising a display part and a fabric covered the display-part, said fabric further comprising a fiber substrate, a parylene layer formed on the fiber substrate, and an antibacterial layer formed on the parylene layer.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
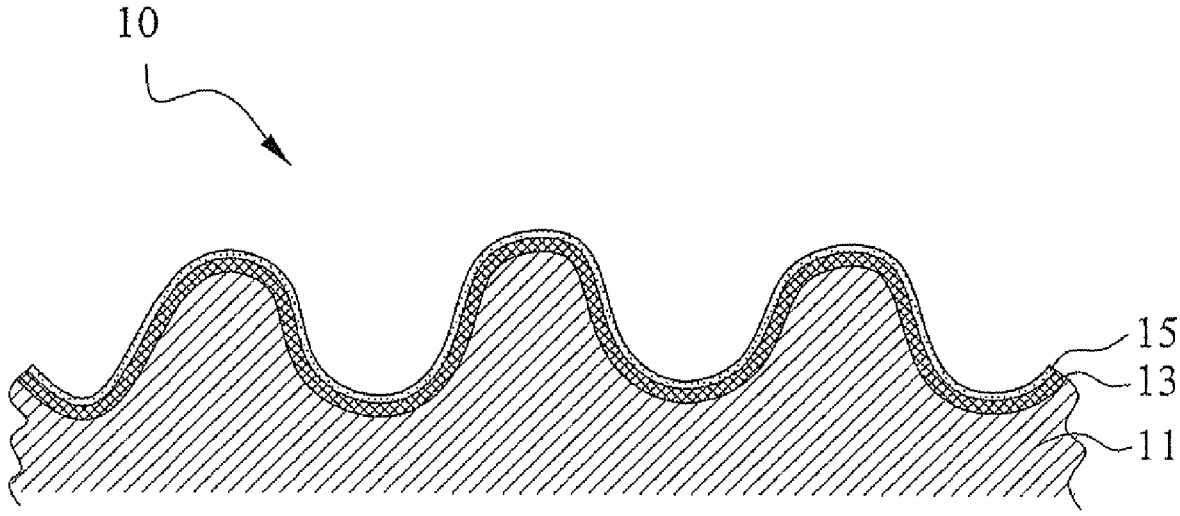
FIG. 1 is an illustrative diagram showing a partially enlarged structure of the fabric of this invention.

Referring to FIG. 1, an illustrative diagram showing a partially enlarged structure of the fabric 10 of this invention. The fabric 10 of this invention mainly comprises a three-layered structure consisting of a fiber substrate 11, a parylene layer 13, and an antibacterial layer 15, wherein the parylene layer 13 is formed on the fiber substrate 11, and the antibacterial layer 15 is formed on the parylene layer 13.

It is appreciated that in all of the above aspects of the invention, the fabric 10 used by this invention may have a wide range. For example, it may be, but not limited to, fuzz, non-woven, knitting cloth, flexible cloth, twill, lycra, jacquard, nylon, artificial silk, waterproof cloth, flannelette, suede, elastic fiber, et cetera. Also, it may be artificial fiber, natural fiber, or a mixture thereof.

The parylene layer 13 mainly comprises a polymer having a skeletal basis identical to p-xylene or its derivatives. The polymer may be parylene N, parylene C, parylene N, et cetera. In addition, the parylene layer 13 is transparent layer and has low permeability; thus, the parylene layer 13 may demonstrate a desirable anti-mold property and a dustproof, waterproof protection effect with a low coefficient of friction, enabling it to be used as a protective layer to block off moisture and dust.

In the antibacterial layer 15 exists more than one bactericidal ingredient. For example, the bactericidal ingredient may be a silver particle or photocatalyst capable of killing germs. Preferably, the bactericidal ingredient has a diameter less than 100 nanometers (nm). Since the techniques for pulverizing silver particles or photocatalyst into nano-particles, such as mechanical polishing or chemical synthesis, are already known, further elaboration is omitted hereby.

Moreover, the photocatalyst may also be a metal oxide such as titanium dioxide, zinc oxide, tin dioxide, et cetera, as well as a sulfide like cadmium sulfide, zinc sulfide, et cetera. The photocatalyst may carry out a catalysis reaction after receiving light with specific wavelength/energy, and its amount remains the same after the reaction.

Figure 2:
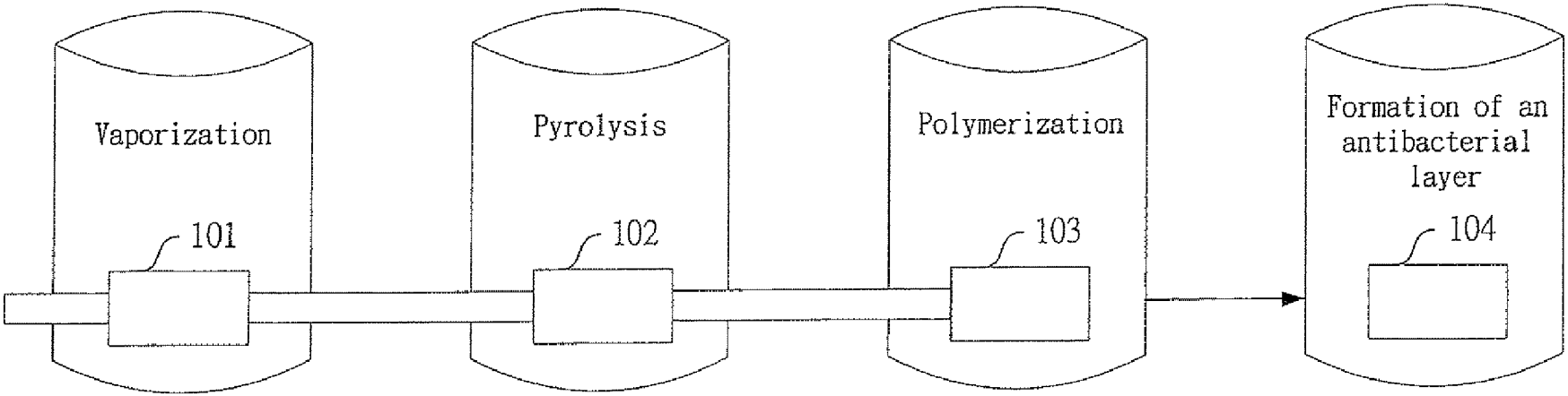
FIG. 2 is a flowchart of the method of this invention.

Refer to FIG. 2 for a flowchart of the method of this invention. Basically, the method of the present invention may be divided into the following steps:

101: Vaporizing Parylene Precursors.

The powder of parylene precursors is vaporized in vacuum at a temperature of 150° C. In this invention, parylene precursors may be substituted or unsubstituted p-xylene dimers, such as mono-substituted or di-substituted chloro-p-xylene dimers.

102: Pyrolyzing the Vaporized Parylene Precursors to Form Parylene Monomers.

After the vaporization, the parylene precursors are treated at a temperature of 650° C. for pyrolyzing them into p-xylene monomers. Similarly, the p-xylene monomers may also be substituted or unsubstituted p-xylene ones, such as mono-substituted or di-substituted chloro-p-xylene monomers.

103: Polymerizing the Parylene Monomers to Form a Parylene Layer on the Fabric.

After the pyrolysis, the gas containing the p-xylene monomers is directed into a coating chamber with the presence of the fabric. At ambient temperature, the gas of p-xylene monomers will gradually deposit onto the fabric and become polymerized, forming a thin film of parylene. Depending on the precursors used before the reaction, parylene formed by the method of the present invention may vary. For instance, if the precursors used at the beginning of the reaction are p-xylene dimers mono-substituted by chlorine, the resulted compound is parylene C; if the precursors used at the beginning of the reaction are p-xylene dimers di-substituted by chlorine, the resulted compound is parylene D; if the precursors used at the beginning of the reaction are unsubstituted p-xylene dimers, the resulted compound will be parylene N.

104: Forming an Antibacterial Layer on the Parylene Layer.

Once coated by the parylene layer, the fabric becomes dustproof and moistureproof. However, in order to further furnish the fabric with an antibacterial function, an antibacterial layer needs to be formed on the parylene layer. The major ingredient of the antibacterial layer may be nano-silver particles and/or nano-photocatalyst. To form the antibacterial layer, a suspension containing nano-silver particles and/or nano-photocatalyst is prepared beforehand; then the suspension is applied onto the parylene layer by spraying, soaking, spreading, or vapor deposition. If the antibacterial layer contains both nano-silver particles and nano-photocatalyst, the bactericidal capability may be sustained by the coordination of mutual characteristics under light and dark conditions.

To have a deeper insight of the technical features of the present invention, two examples are disclosed hereafter:

EXAMPLE 1

By the use of above-mentioned vapor deposition, a parylene layer with a thickness between 1 to 20 micrometers (μm) is formed on the surface of fuzz cloth, said parylene mainly containing parylene N. In the meantime, a suspension for forming an antibacterial layer is prepared by adding silver particles into titanium dioxide powder to form a mixture of 25% by weight, where said silver particles have a diameter between 60 to 80 nm and a concentration of 2% to 5% by weight, and said titanium dioxide has a diameter between 15 to 25 nm and a concentration of 95% to 98% by weight. The preparation is completed by the addition of solvent into the mixture followed by well mixing. In this embodiment, the solvent may be but not limited to alcohol, acetone, xylene, or toluene. After that, the suspension is applied onto the parylene layer by spraying, soaking, spreading, or vapor deposition uniformly so as to form a 0.01 to 5 μm antibacterial layer.

EXAMPLE 2

By the use of above-mentioned vapor deposition, a parylene layer with a thickness between 1 to 20 μm is formed on the surface of fuzz cloth, said parylene mainly containing parylene N. In the meantime, a suspension for forming an antibacterial layer is prepared by adding silver particles into zinc oxide powder to form a mixture of 25% by weight, where said silver particles have a diameter between 60 to 80 nm and a concentration of 2% to 5% by weight, and said zinc oxide has a diameter between 15 to 25 nm and a concentration of 95% to 98% by weight. The preparation is completed by the addition of solvent into the mixture followed by well mixing. In this embodiment, the solvent may be but not limited to alcohol, acetone, xylene, or toluene. After that, the suspension is applied onto the parylene layer by spraying, soaking, spreading, or vapor deposition uniformly so as to form a 0.01 to 5 μm antibacterial layer.

Figure 3:
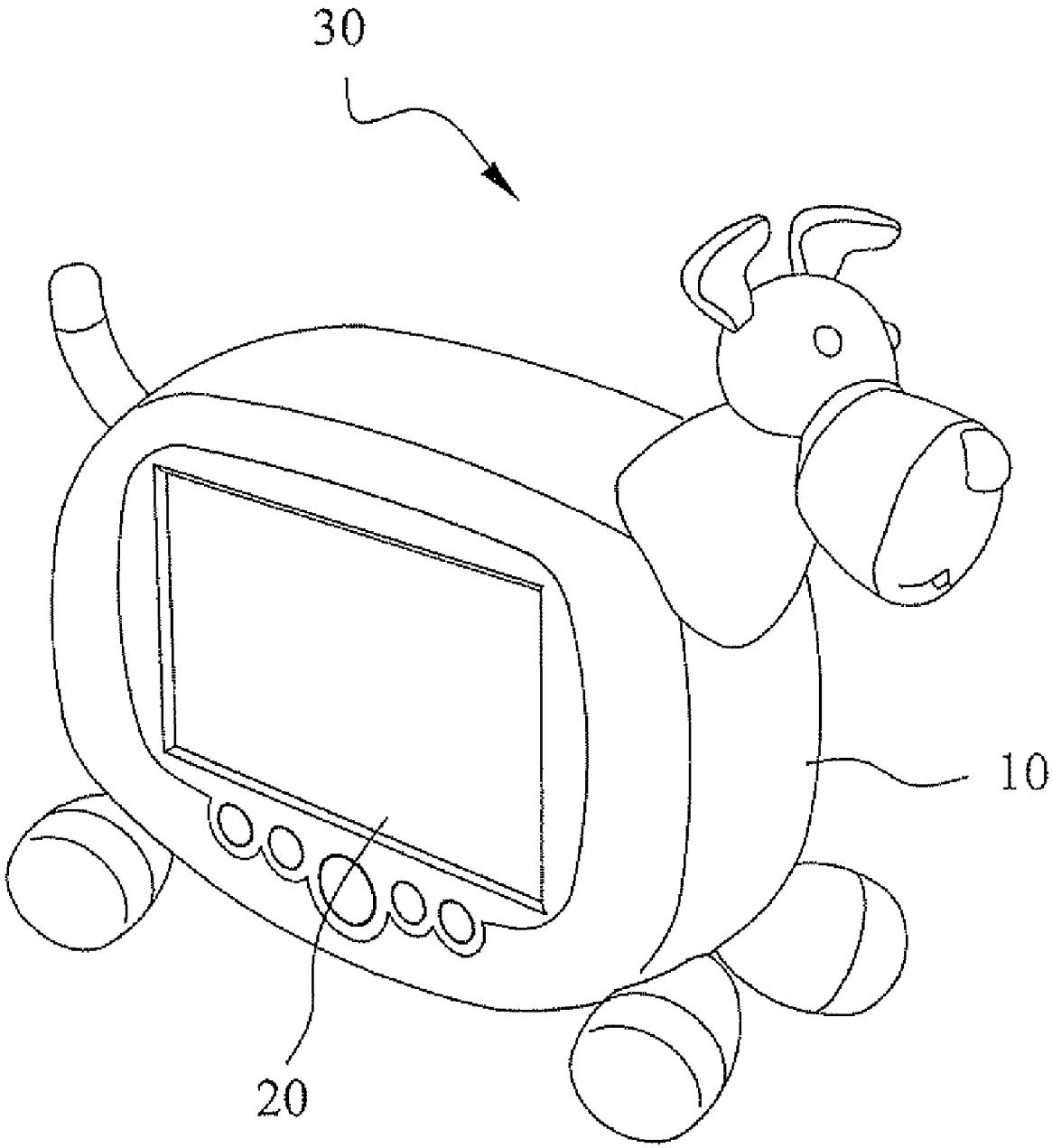
FIG. 3 is an illustrative diagram of the display having a cover of this invention.

Finally, turn to FIG. 3 for an illustrative diagram of a display 30 having a fabric cover of this invention. As shown, the display 30 mainly comprises a display part 20 and a fabric 10 covered thereon. The fabric 10 has a three-layered structure: a fiber substrate, a parylene layer, and an antibacterial layer. Thus, the fabric 10 not only furthers the appearance and design of the display part 20 but also provides a dustproof, moisture proof, and antibacterial function. Also, it is appreciated that in all of the above aspects of the invention, the display part 20 may be, but not limited to, a CRT display as well as a LCD display or a plasma display (i.e. video display).

Although the present invention has been explained in relation to its preferred embodiments, it is to be understood that many other possible modifications and variations can be made without departing from the spirit and scope of the invention as hereinafter claimed.

What is claimed is:

1. A display, comprising;

a display part, the display part being a video display;

a cover including a fabric for covering the display part, said fabric comprising:

a fiber substrate;

a parylene layer formed on the fiber substrate; and an antibacterial layer formed on the parylene layer.

2. The display having a cover as claimed in claim 1, wherein the parylene layer comprises parylene N.

3. The display having a cover as claimed in claim 1, wherein the antibacterial layer comprises at least one bactericidal ingredient, said bactericidal ingredient being a nano-silver particle or photocatalyst.

4. The display having a cover as claimed in claim 3, wherein said photocatalyst is titanium dioxide.

5. The display having a cover as claimed in claim 3, wherein said photocatalyst is zinc oxide.

6. The display having a cover as claimed in claim 4, wherein the bactericidal ingredient has a diameter less than 100nanometers.

* * * * *